US007481341B2

(12) United States Patent
Liang

(10) Patent No.: US 7,481,341 B2
(45) Date of Patent: Jan. 27, 2009

(54) GARMENT HANGER

(76) Inventor: Joseph Liang, No. 30, Hsing-Tien Rd., Lin 11, Hsin-Nan Tsun, Kao-Shu Hsiang, Ping-Tung Hsien (TW)

( * ) Notice: Subject to any disclaimer, the term of this patent is extended or adjusted under 35 U.S.C. 154(b) by 0 days.

(21) Appl. No.: 11/764,390

(22) Filed: Jun. 18, 2007

(65) Prior Publication Data

US 2008/0308586 A1 Dec. 18, 2008

(51) Int. Cl.
*A41D 27/22* (2006.01)

(52) U.S. Cl. ..... 223/94; 223/85; 223/89

(58) Field of Classification Search ..... 223/85, 223/88, 89, 92, 94, 95; D6/318
See application file for complete search history.

(56) References Cited

U.S. PATENT DOCUMENTS

| | | | | | |
|---|---|---|---|---|---|
| 640,616 | A * | 1/1900 | Brock | ..... | 223/94 |
| 1,207,338 | A * | 12/1916 | Stone | ..... | 223/94 |
| 1,385,449 | A * | 7/1921 | Heinle | ..... | 223/94 |
| 3,225,979 | A * | 12/1965 | Lundman | ..... | 223/94 |
| 3,254,814 | A * | 6/1966 | Weir et al. | ..... | 223/89 |
| 5,044,535 | A * | 9/1991 | Hunt | ..... | 223/95 |
| 5,511,701 | A * | 4/1996 | Lam | ..... | 223/85 |
| 5,664,710 | A * | 9/1997 | Lam | ..... | 223/94 |
| 5,901,888 | A * | 5/1999 | Schneider et al. | ..... | 223/89 |
| 6,158,634 | A * | 12/2000 | Kelroy | ..... | 223/89 |
| 6,637,630 | B1 * | 10/2003 | Rivenburgh | ..... | 223/85 |
| 6,644,520 | B2 * | 11/2003 | Lam | ..... | 223/94 |
| 2005/0199656 | A1 * | 9/2005 | Harvey et al. | ..... | 223/94 |

FOREIGN PATENT DOCUMENTS

| | | | |
|---|---|---|---|
| JP | 2003334400 | A * | 11/2003 |
| JP | 2006247299 | A * | 9/2006 |

* cited by examiner

*Primary Examiner*—Gary L Welch
*Assistant Examiner*—Nathan E Durham
(74) *Attorney, Agent, or Firm*—McNees Wallace & Nurick, LLC

(57) ABSTRACT

A garment hanger includes: a neck part having upper and lower ends and opposite first and second ends extending between the upper and lower ends; a hook extending from the neck part; a first shoulder adapted to support one of shoulders of a garment; and a second shoulder bar mounted movably on the neck part and adapted to support the other of the shoulders of the garment. The first and second shoulder bars diverge from the neck part in a first direction when the second shoulder bar is disposed at an extended position, and diverge from the first end of the neck part in a second direction different from the first direction when the second shoulder bar is disposed at a retracted position.

5 Claims, 8 Drawing Sheets

GARMENT HANGER

BACKGROUND OF THE INVENTION

1. Field of the Invention

The invention relates to a garment hanger, more particularly to a garment hanger having a neck part and a shoulder bar connected movably to the neck part.

2. Description of the Related Art

As shown in FIG. 1, a conventional garment hanger includes a hanger body 1 and two sleeves 2 sleeved slidably on the hanger body 1. The hanger body 1 includes a frame part 101 that has two shoulder bar portions 103, and a hook 102 extending upwardly from one of the shoulder bar portions 103. Each of the sleeves 2 has a plurality of inner rib plates 201, each of which defines an engaging groove 202 for extension of a respective one of the shoulder bar portions 103 of the frame part 101 therethrough.

Through sliding movement of the sleeves 2 on the shoulder bar portions 103 of the frame part 101, the garment hanger can be used for garments having different shoulder sizes. Although the sleeves 2 can be adjusted, the distance between free ends 1031 of the shoulder bar portions 103 of the frame part 101 is not changed accordingly and remains the same. As such, when the garment hanger is to be used for hanging a garment having a narrow neck opening (see FIG. 2), it is relatively inconvenient to insert the shoulder bar portions 103 of the frame part 101 through the neck opening of the garment.

SUMMARY OF THE INVENTION

Therefore, the object of the present invention is to provide a garment hanger that can overcome the aforesaid drawback associated with the prior art.

According to this invention, a garment hanger comprises: a neck part having upper and lower ends and opposite first and second ends extending between the upper and lower ends; a hook extending upwardly from the upper end of the neck part; a first shoulder bar extending from the first end of the neck part and adapted to support one of shoulders of a garment, the first shoulder bar having a free end; and a second shoulder bar mounted movably on the neck part, adapted to support the other of the shoulders of the garment, and having a free end distal from the first end of the neck part and proximate to the second end of the neck part. The second shoulder bar is movable relative to the neck part between extended and retracted positions so as to permit length adjustment between the free ends of the first and second shoulder bars. The first and second shoulder bars diverge from the neck part in a first direction when the second shoulder bar is disposed at the extended position, and diverge from the first end of the neck part in a second direction different from the first direction when the second shoulder bar is disposed at the retracted position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
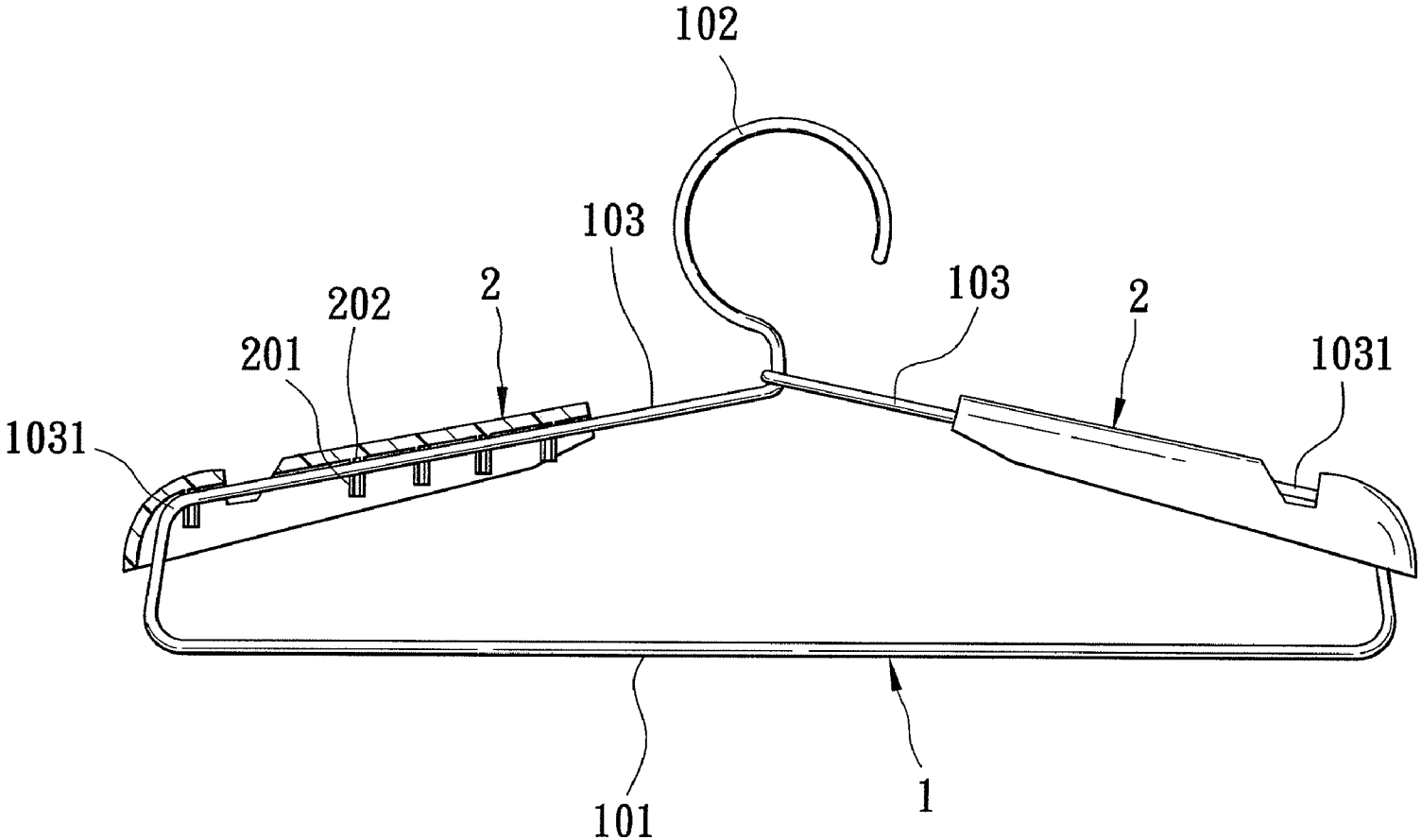
FIG. 1 PRIOR ART
FIG. 1 is a schematic partly sectional view of a conventional garment hanger.
Figure 2:
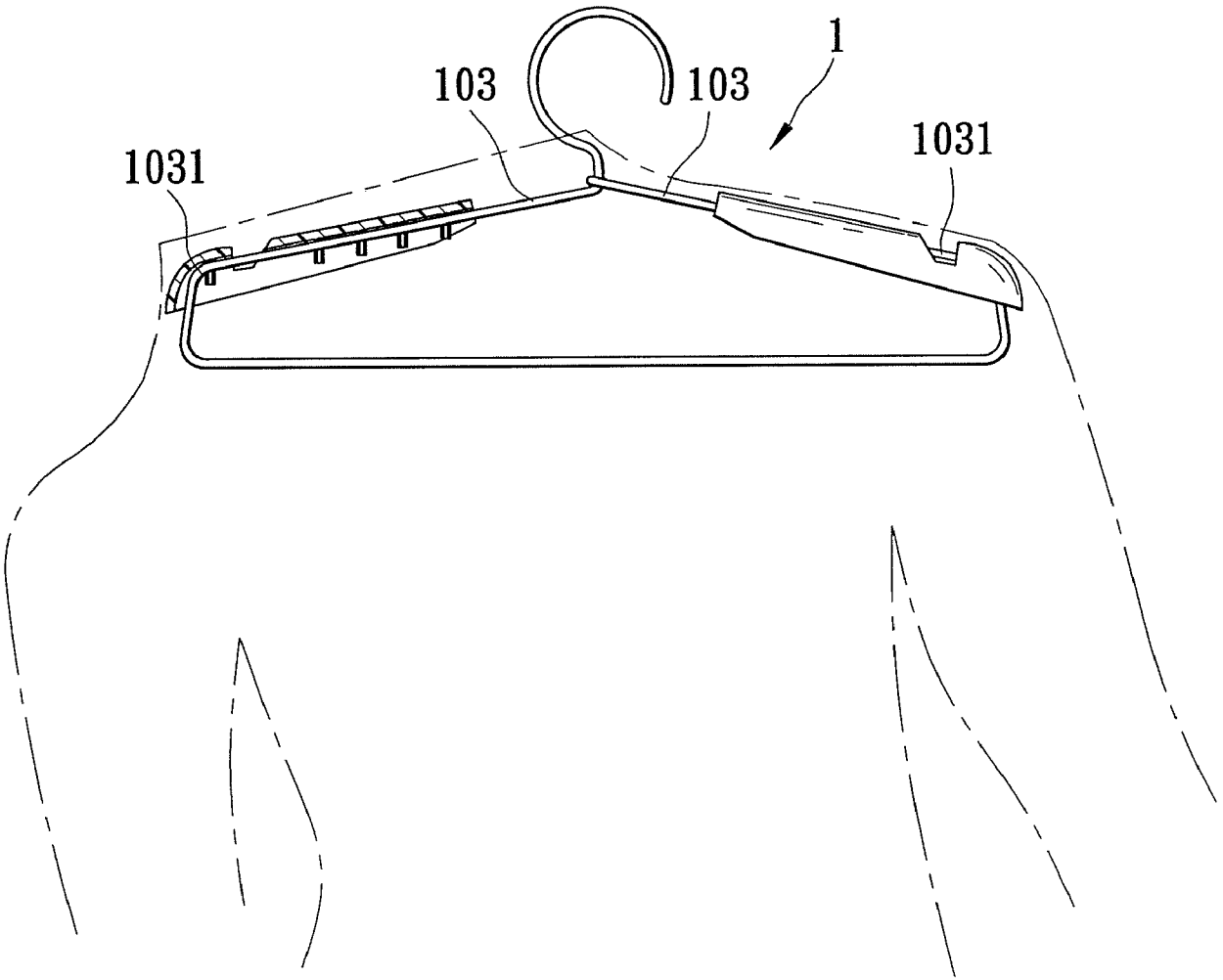
FIG. 2 PRIOR ART
FIG. 2 is a schematic partly sectional view to illustrate the conventional garment hanger in a state of use.
Figure 3:
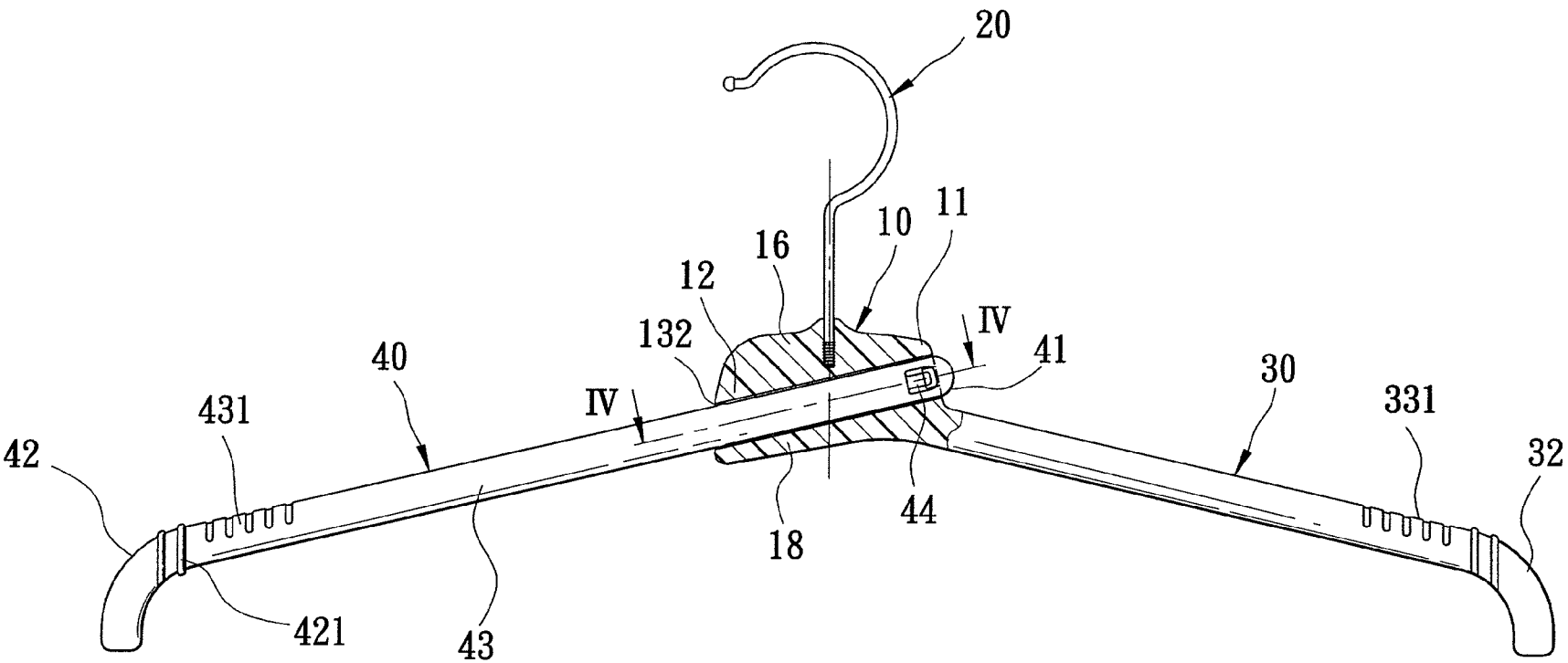
FIG. 3 is a schematic partly sectional view of the preferred embodiment of a garment hanger according to the present invention.
Figure 6:
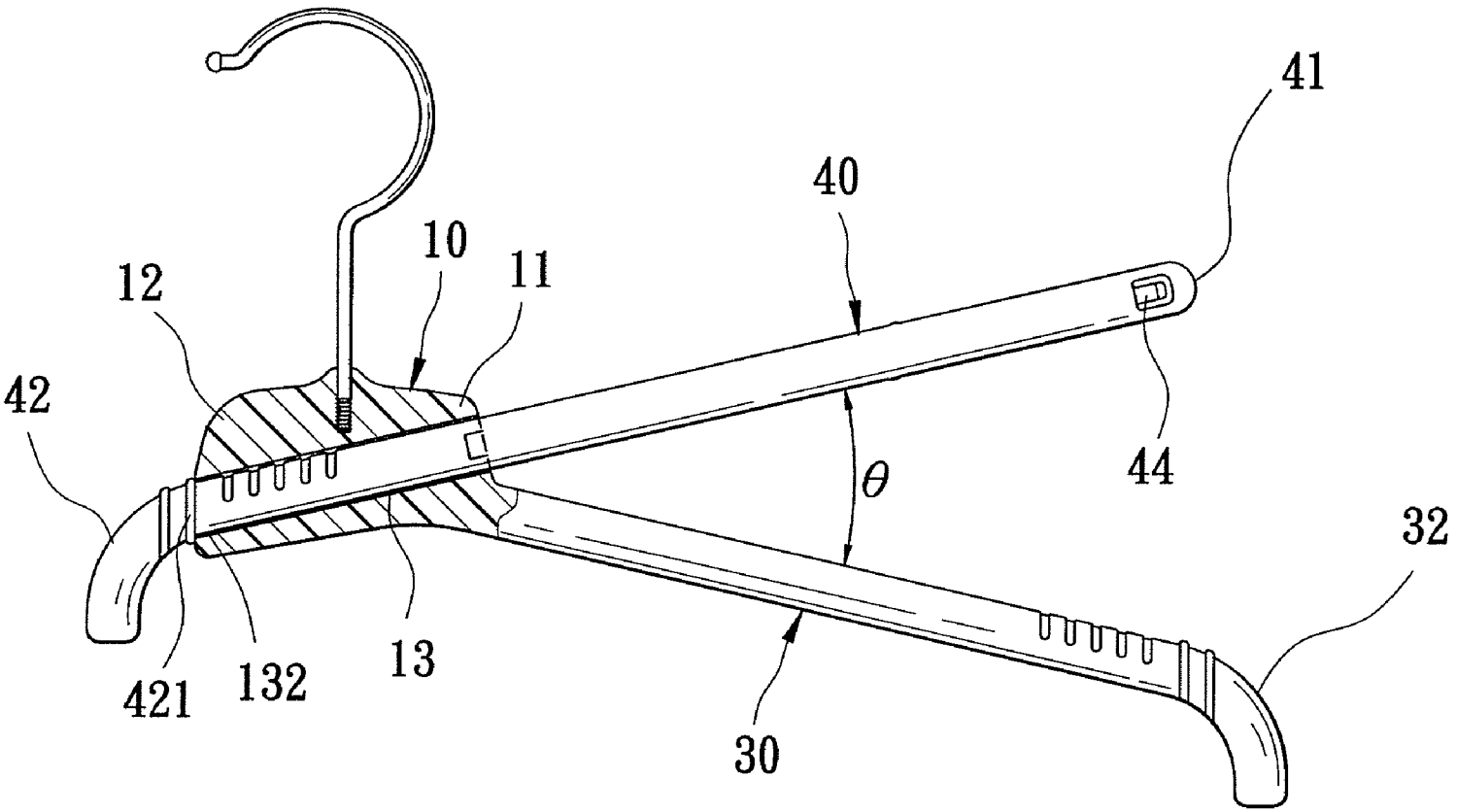
FIG. 6 is a schematic partly sectional view to illustrate a state where the second shoulder bar is disposed at a retracted position.

Referring to FIG. 3, the preferred embodiment of a garment hanger according to the present invention is shown to include: a neck part 10 having upper and lower ends 16, 18 and opposite first and second ends 11, 12 extending between the upper and lower ends 16, 18; a hook 20 extending upwardly from the upper end 16 of the neck part 10; a first shoulder bar 30 extending from the first end 11 of the neck part 10 and adapted to support one of shoulders of a garment (see FIG. 7), the first shoulder bar 30 having a free end 32; and a second shoulder bar 40 mounted movably on the neck part 10, adapted to support the other of the shoulders of the garment (see FIG. 8), and having a free end 42 distal from the first end 11 of the neck part 10 and proximate to the second end 12 of the neck part 10. The second shoulder bar 40 is movable relative to the neck part 10 between extended and retracted positions (see FIGS. 3 and 6) so as to permit length adjustment between the free ends 32, 42 of the first and second shoulder bars 30, 40. The first and second shoulder bars 30, 40 diverge from the lower end 18 of the neck part 10 in a first direction when the second shoulder bar 40 is disposed at the extended position (see FIG. 3), and diverge from the first end 11 of the neck part 10 in a second direction different from and substantially transverse to the first direction when the second shoulder bar 40 is disposed at the retracted position (see FIG. 6).

Figure 4:
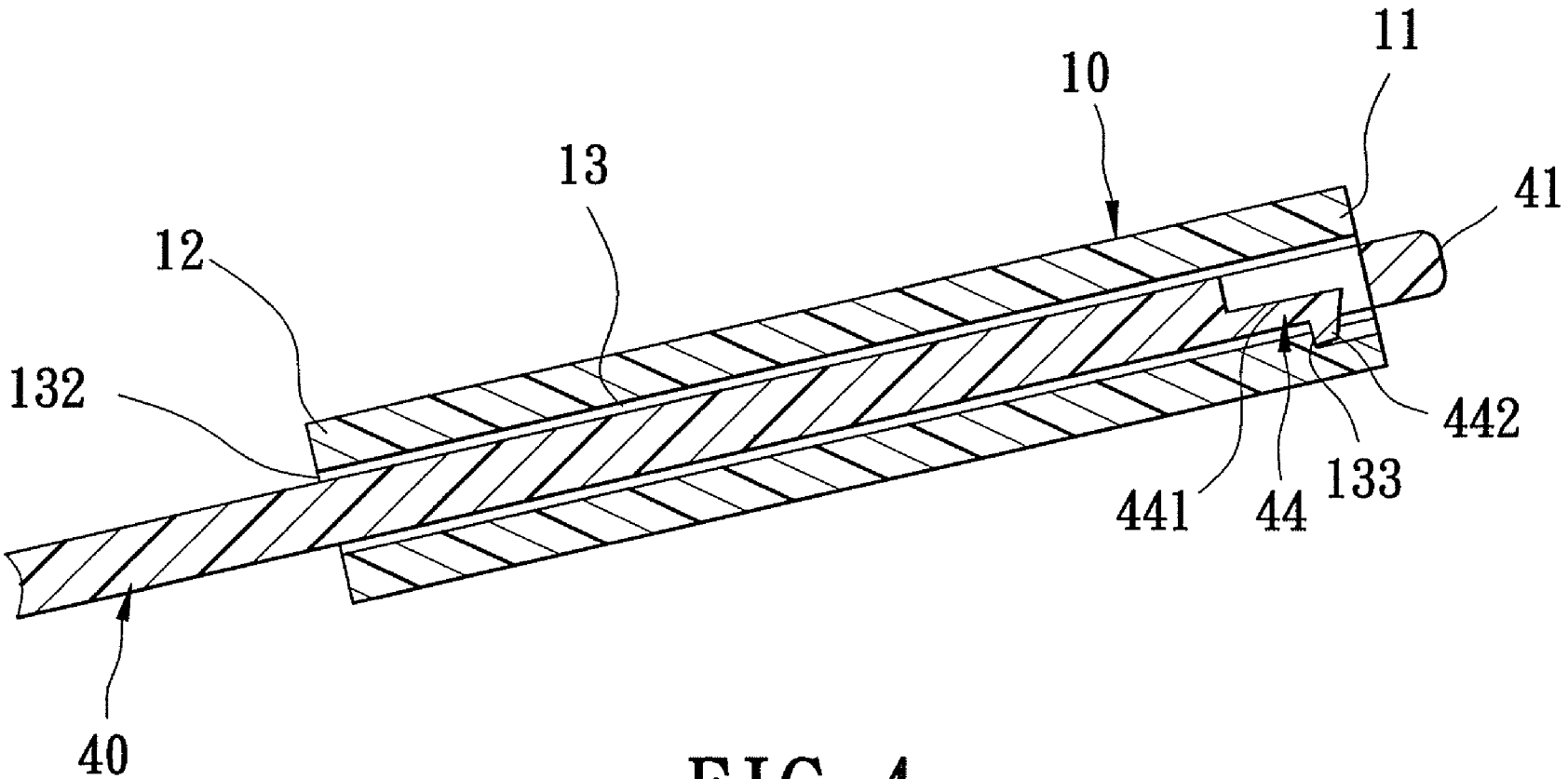
FIG. 4 is a fragmentary sectional view taken along line IV-IV in FIG. 3.

In this embodiment, referring to FIG. 4, in combination with FIG. 3, the neck part 10 is formed with a channel 13 extending through the first and second ends 11, 12 of the neck part 10. The second shoulder bar 40 extends movably into the channel 13.

The second shoulder bar 40 further has a connecting end 41 opposite to the free end 42 of the second shoulder bar 40 and formed with a tongue 44 protruding therefrom. The channel 13 in the neck part 10 is defined by a channel-defining wall that is formed with a shoulder 133. The tongue 44 abuts against the shoulder 133 when the second shoulder bar 40 is disposed at the extended position, and is disposed outwardly of the channel 13 when the second shoulder bar 40 is disposed at the retracted position.

The first and second shoulder bars 30, 40 are formed into a generally V-shape (see FIG. 3) with an obtuse angle when the second shoulder bar 40 is disposed at the extended position. The second shoulder bar 40 further has a middle portion 43 extending between the free end 42 and the connecting end 41 of the second shoulder bar 40. The middle portion 43 of the second shoulder bar 40 extends outwardly of the channel 13 from the second end 12 of the neck part 10 when the second shoulder bar 40 is disposed at the extended position, and extends outwardly of the channel 13 from the first end 11 of the neck part 10 and cooperates with the first shoulder bar 30 to form into a generally V-shape with an acute angle θ (see FIG. 6) when the second shoulder bar 40 is disposed at the retracted position.

Referring once more to FIG. 4, the tongue 44 has a flexible arm portion 441 protruding from the connecting end 41 of the second shoulder bar 40, and a protrusion 442 protruding from the flexible arm portion 441 and abutting against the shoulder 133 when the second shoulder bar 40 is disposed at the extended position.

Figure 5:
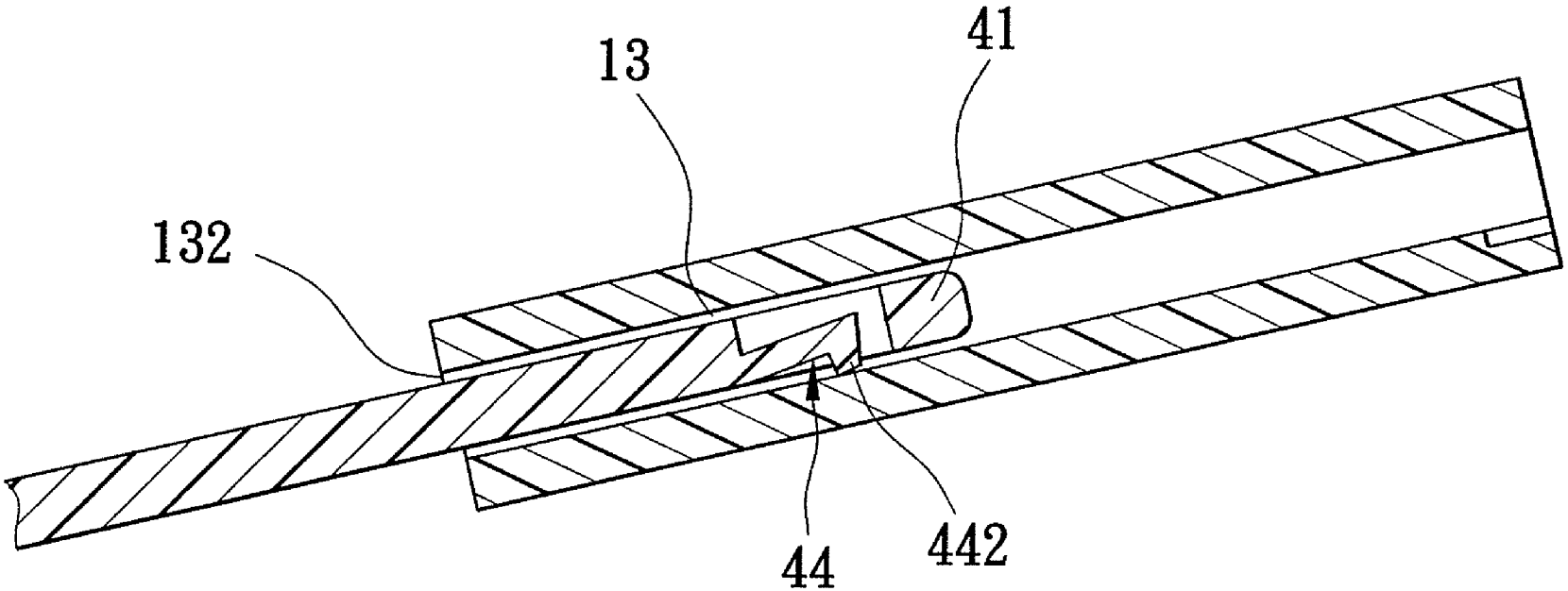
FIG. 5 is a fragmentary sectional view to illustrate how the second shoulder bar is inserted into a channel in the neck part of the preferred embodiment.

The first and second shoulder bars 30, 40 and the neck part 10 are preferably made from a plastic material. During assembly of the garment hanger, as shown in FIG. 5, the second shoulder part 40 is inserted through one end 132 of the channel 13 and is further moved forward until the tongue 44 is brought into snap engagement with the shoulder 133.

Preferably, the second shoulder bar 40 is formed with a stopper 421 (see FIG. 3) protruding therefrom and disposed adjacent to the free end 42 of the second shoulder bar 40. The stopper 421 abuts against the second end 12 of the neck part 10 when the second shoulder bar 40 is disposed at the retracted position (see FIG. 6).

Moreover, each of the first and second shoulder bars 30, 40 is formed with a plurality of anti-slip ribs 331, 431 protruding therefrom.

In this embodiment, the hook 20 is preferably made from metal.

Figure 7:
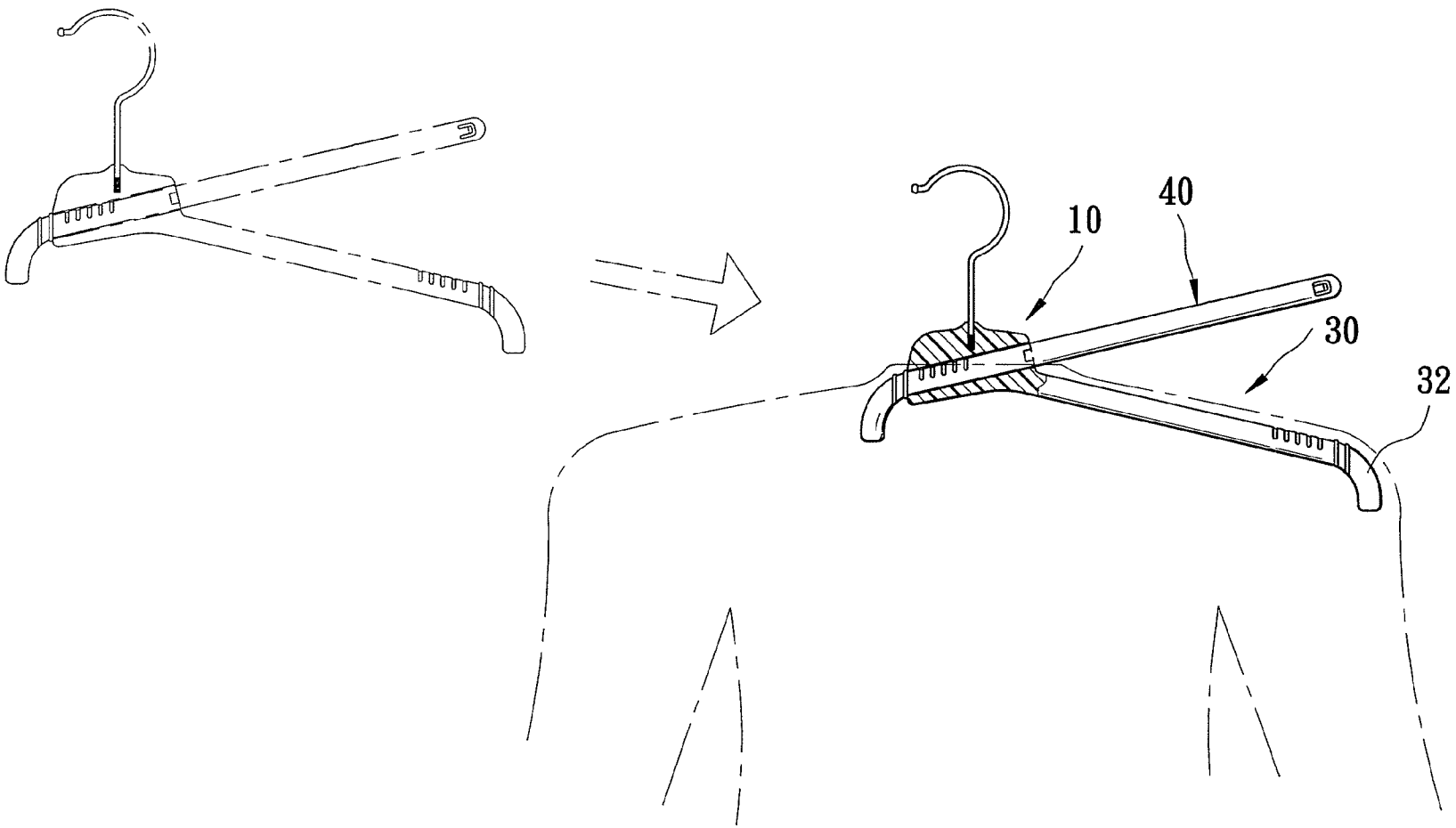
FIGS. 7 and 8 are schematic partly sectional views to illustrate consecutive steps of inserting the shoulders of the preferred embodiment into a garment.
Figure 8:
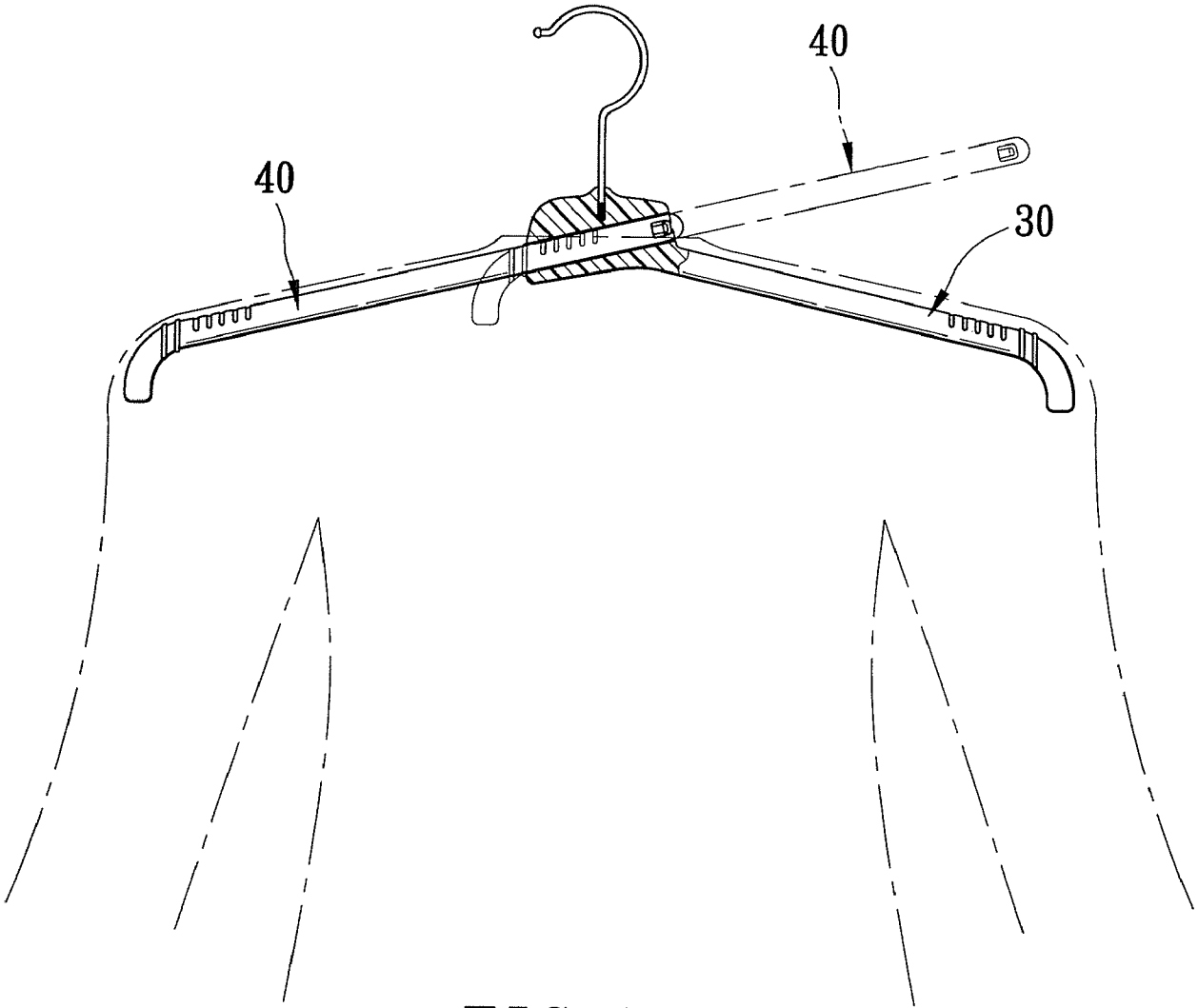

In operation, when a garment having a narrow neck opening is to be hung on the garment hanger, the second shoulder bar 40 is first moved to the retracted position so as to facilitate insertion of the first shoulder bar 30 through the neck opening of the garment (see FIG. 7). The second shoulder bar 40 is then moved from the retracted position to the extended position and through the neck opening of the garment (see FIG. 8).

To remove the garment from the garment hanger, the second shoulder bar 40 is first moved to the retracted position so as to facilitate subsequent removal of the first shoulder bar 30 from the garment through the neck opening.

By mounting movably the second shoulder bar 40 on the neck part 10 of the garment hanger of this invention, the aforesaid drawback associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A garment hanger comprising:

a neck part having upper and lower ends and opposite first and second ends extending between said upper and lower ends;

a hook extending upwardly from said upper end of said neck part;

a first shoulder bar extending from said first end of said neck part and adapted to support one of shoulders of a garment, said first shoulder bar having a free end; and a second shoulder bar mounted movably on said neck part, adapted to support the other of the shoulders of the garment, and having a free end distal from said first end of said neck part and proximate to said second end of said neck part, said second shoulder bar being movable relative to said neck part between extended and retracted positions so as to permit length adjustment between said free ends of said first and second shoulder bars;

wherein said neck part is formed with a channel extending through said first and second ends of said neck part, said second shoulder bar extending movably into said channel;

wherein said second shoulder bar further has a connecting end opposite to said free end of said second shoulder bar and formed with a tongue protruding therefrom, said channel in said neck part being defined by a channel-defining wall that is formed with a shoulder, said tongue abutting against said shoulder when said second shoulder bar is disposed at the extended position, and being disposed outwardly of said channel when said second shoulder bar is disposed at the retracted position; and wherein said second shoulder bar further has a middle portion extending between said free end and said connecting end of said second shoulder bar, said middle portion of said second shoulder bar extending outwardly of said channel from said second end of said neck part when said second shoulder bar is disposed at the extended position, and extending outwardly of said channel from said first end of said neck part and cooperating with said first shoulder bar to form into a generally V-shape with an acute angle when said second shoulder bar is disposed at the retracted position.

2. The garment hanger as claimed in claim 1, wherein said tongue has a flexible arm portion protruding from said connecting end of said second shoulder bar, and a protrusion protruding from said flexible arm portion and abutting against said shoulder when said second shoulder bar is disposed at the extended position.

3. The garment hanger as claimed in claim 1, wherein said second shoulder bar is formed with a stopper protruding therefrom and disposed adjacent to said free end of said second shoulder bar, said stopper abutting against said second end of said neck part when said second shoulder bar is disposed at the retracted position.

4. The garment hanger as claimed in claim 1, wherein each of said first and second shoulder bars is formed with a plurality of anti-slip ribs protruding therefrom.

5. The garment hanger as claimed in claim 1, wherein said first and second shoulder bars are formed into a generally V-shape with an obtuse angle when said second shoulder bar is disposed at the extended position.

* * * * *